US008965234B2

(12) United States Patent
Ikuta et al.

(10) Patent No.: US 8,965,234 B2
(45) Date of Patent: Feb. 24, 2015

(54) IMAGE FORMING SYSTEM AND METHOD OF CONTROLLING THE SAME

(71) Applicants: Katsuyuki Ikuta, Hamamatsu (JP); Akira Okamoto, Hino (JP); Kenji Yamamoto, Hachioji (JP); Hiroyuki Futami, Hachioji (JP); Akifumi Isobe, Hidaka (JP)

(72) Inventors: Katsuyuki Ikuta, Hamamatsu (JP); Akira Okamoto, Hino (JP); Kenji Yamamoto, Hachioji (JP); Hiroyuki Futami, Hachioji (JP); Akifumi Isobe, Hidaka (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 14 days.

(21) Appl. No.: 13/783,695

(22) Filed: Mar. 4, 2013

(65) Prior Publication Data

US 2013/0243468 A1 Sep. 19, 2013

(30) Foreign Application Priority Data

Mar. 13, 2012 (JP) ..... 2012-055713

(51) Int. Cl.
*G03G 15/20* (2006.01)
*G03G 15/23* (2006.01)
(Continued)

(52) U.S. Cl.
CPC ..... *G03G 15/231* (2013.01); *G03G 15/0189* (2013.01); *G03G 15/238* (2013.01); *G03G 21/1604* (2013.01)
USPC ..... 399/82; 399/38; 399/76; 358/1.4; 358/1.5; 358/1.18

(58) Field of Classification Search
USPC ..... 399/38, 76, 82; 358/1.4, 1.5, 1.9, 1.13, 358/1.18; 347/262
See application file for complete search history.

(56) References Cited

U.S. PATENT DOCUMENTS 8,494,392 B2 * 7/2013 Kasahara ..... 399/76
2006/0233569 A1 * 10/2006 Furst et al. ..... 399/162
(Continued)

FOREIGN PATENT DOCUMENTS

JP 10-086455 A 4/1998
JP 2005-022243 A 1/2005
JP 2012068286 A * 4/2012

OTHER PUBLICATIONS

Japanese Office Action, Rejection of Notice, Japanese Patent Application No. 2012-055713, Drafting Date: Jun. 27, 2014, Dispatch Date: Jul. 1, 2014 (2 pages) and English translation (2 pages).

*Primary Examiner* — Francis Gray
(74) *Attorney, Agent, or Firm* — Lucas & Mercanti, LLP

(57) ABSTRACT

In a serial tandem image forming system having a plurality of image forming apparatuses, a double-side printing job can be performed in a way according to the needs of users by taking into consideration an adjustment operation. The serial tandem image forming system includes an upstream apparatus 200 and a downstream apparatus 300, as the image forming apparatuses, each of which is capable of forming images on both sides of a sheet. When receiving a double-side printing job while one of the image forming apparatuses is performing the adjustment operation, a control unit 260 displays information on a manipulation display 500 which prompts a user to select whether to immediately start the job by performing a single machine double-side printing process with the other image forming apparatus, or start the job by shifting to a tandem mode and performing a serial double-side printing process after the adjustment operation has finished.

9 Claims, 4 Drawing Sheets

(51) Int. Cl.
*G03G 15/01* (2006.01)
*G03G 21/16* (2006.01)

(56) References Cited

U.S. PATENT DOCUMENTS

2010/0296829 A1* 11/2010 Young et al. ..... 399/76
2011/0076045 A1* 3/2011 Sobue ..... 399/81
2011/0150520 A1* 6/2011 Kasahara ..... 399/76
2012/0057201 A1* 3/2012 Tsukamoto ..... 358/1.15
2012/0070176 A1* 3/2012 Nose ..... 399/82
2012/0087690 A1* 4/2012 Kudo et al. ..... 399/82

* cited by examiner

IMAGE FORMING SYSTEM AND METHOD OF CONTROLLING THE SAME

CROSS-REFERENCE TO RELATED APPLICATIONS

The present application claims priority under 35 U.S.C. §119 to Japanese Patent Application No. P2012-55713, filed Mar. 13, 2012. The contents of this application are herein incorporated by reference in their entirety.

FIELD OF INVENTION

The present invention relates to an image forming system and a method of controlling the same.

DESCRIPTION OF RELATED ART

In recent years, serial tandem image forming system with serially-connected image forming apparatuses have been put to practical use. For example, in the case of a serial tandem image forming system consisting of two image forming apparatuses, a double-side printing job is performed by forming an image on one side of a sheet with one of the image forming apparatuses (upstream apparatus) which is located in the upstream side and then forming an image on the other side of the sheet with the other image forming apparatus (downstream apparatus) which is located in the downstream side. Such a serial tandem image forming system, can thereby form images on both sides of a sheet in a shorter printing time than an individual image forming apparatus, so that the productivity can be significantly improved.

For example, Japanese Patent Published Application No. 2005-22243 and Japanese Patent Published Application No. Hei10-86455 disclose serial tandem image forming systems which can perform a double-side printing job by forming an image on different sides of sheet with each of the upstream apparatus and the downstream apparatus. Each image forming apparatus of the image forming system is configured to solely perform a double-side printing job on the opposite sides of a sheet. This makes it possible to perform a double-side printing job with one of the image forming apparatuses even when the other image forming apparatus is broken down and not available.

Incidentally, the image forming apparatus used in such an image forming system starts an adjustment operation for adjusting the performance of an image formation process with a predetermined timing, for example, at system start-up in order to achieve an image formation precision in a level, which meets a predetermined standard. In this case, while either or both of the image forming apparatuses are performing an adjustment operation, such an image forming apparatus can not perform a job and there is a problem that a double-side printing job cannot start, until both the image forming apparatuses become ready to operate after finishing the adjustment operation. Because of this, if a job is requested during an adjustment operation, it takes a certain time to start the requested job so that there is the shortcoming that the downtime of the system is increased.

In addition to this, according to the technique described in Japanese Patent Published Applications No. 2005-22243 and Hei10-86455, when one of the image forming apparatuses becomes inoperative, the system cannot autonomously recover from the trouble to its operating state so that, maintenance work may be necessary by a personnel, and the troublesome state continues for a long time with lower productivity in regard to double-side printing.

The present invention has been made in order to solve the shortcomings as described above. It is an object of the present invention therefore to provide a tandem image forming system having a plurality of image forming apparatuses capable of performing a double-side printing job in a way according to the needs of users by taking into consideration an adjustment operation which is sometimes performed in one or more image forming apparatus.

SUMMARY OF THE INVENTION

To achieve at least one of the abovementioned objects, an image forming system reflecting one aspect of the present invention comprises: a first image forming apparatus configured to form images on one side and both sides of a sheet; a second image forming apparatus connected to said first image forming apparatus in series and configured to receive a sheet, which is discharged from said first image forming apparatus, and form images on one side and both sides of the sheet; an information presentation device configured to inform a user of information; an input device configured to receive a command input by the user; and a control device configured to said first image forming apparatus and said second image forming apparatus. In this case, when starting a job of printing both sides of sheets while one of said first image forming apparatus and said second image forming apparatus is performing an adjustment operation for adjusting the performance of image formation; said control device provides information through said information presentation device which prompts the user to select whether to start the job by forming images on both sides of each sheet as a first double-side printing process with the other image forming apparatus which is not performing the adjustment operation, or start the job, after said one image forming apparatus has finished the adjustment operation, by forming an image on one side of each sheet with said first image forming apparatus and then forming an image on the other side of said each sheet with said second image forming apparatus as a second double-side printing process.

Preferably, if the adjustment operation of the one of said first and second image forming apparatuses has finished before completely finishing the printing process of a job which is started in accordance with the selection by the user as said first double-side printing process, said control device switches said first double-side printing process to said second double-side printing process to perform the backlog of the job.

Preferably, said control device provides reference information about the characteristics of said first double-side printing process and said second double-side printing process through said information presentation device.

Preferably, the image forming system further comprises a discharge device connected to said second image forming apparatus in series and configured to receive a sheet output from said second image forming apparatus and discharge the sheet to a catch tray, wherein said control device controls said discharge device in order to make clear the boundary between a stack of sheets printed by said first double-side printing process and a stack of sheets printed by said second double-side printing process.

Preferably, when both said first image forming apparatus and said second image forming apparatus are performing the adjustment operation, said control device waits until one of said first image forming apparatus and said second image forming apparatus finishes the adjustment operation, and then performs the job of printing both sides of sheets.

DETAILED DESCRIPTION OF THE PREFERRED EMBODIMENT

Figure 1:
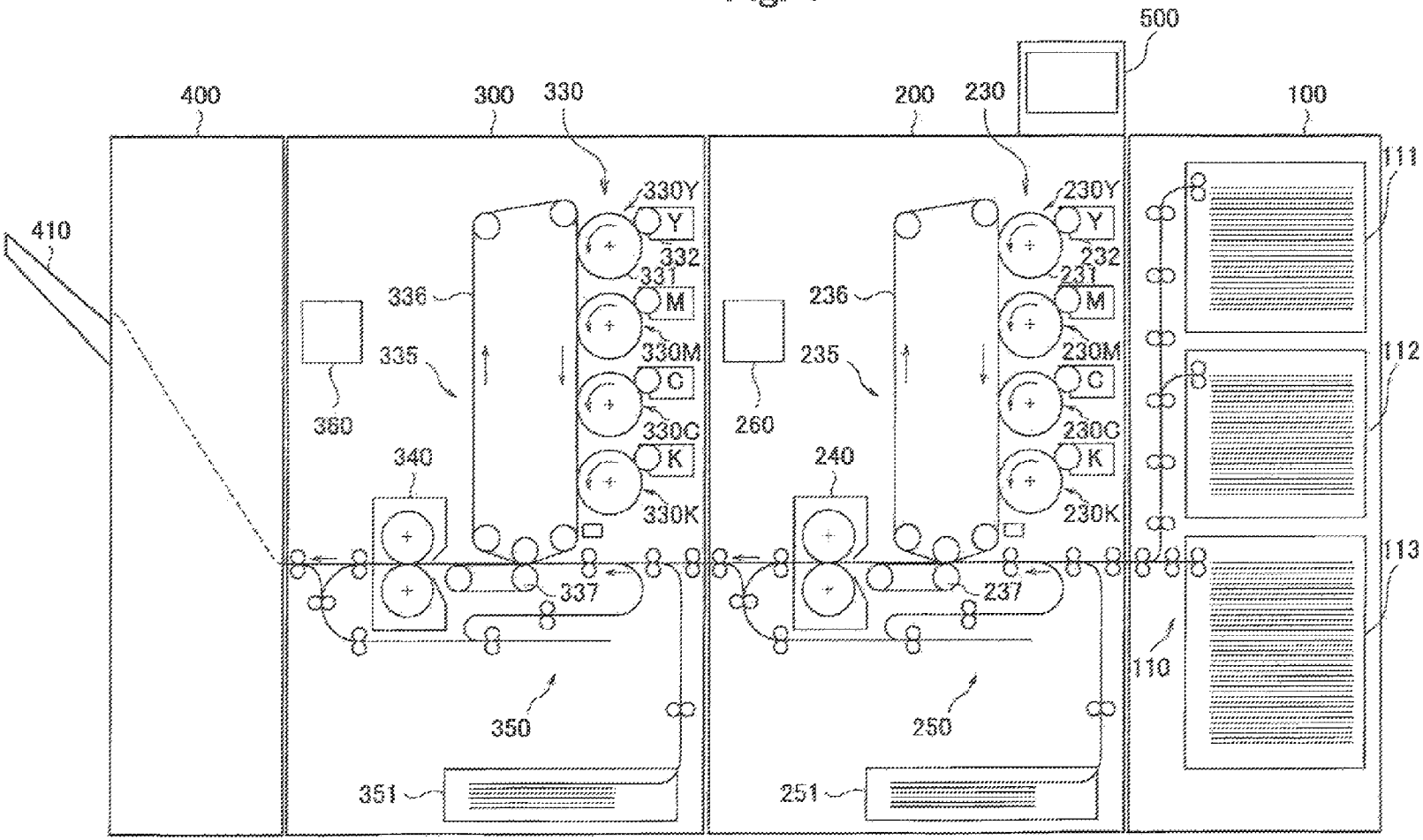
FIG. 1 is a view for schematically showing the configuration of an image forming system.

FIG. 1 is a view for schematically showing the configuration of an image forming system according to the present embodiment. The image forming system is provided with a large volume paper feed unit 100, an upstream apparatus 200, a downstream apparatus 300, a discharge device 400, and a manipulation display 500. The upstream apparatus 200 and downstream apparatus 300 are electrophotographic image forming apparatuses, for example copying machines. The image forming system as a serial tandem image forming system has two image forming device which have the same configuration and connected in series. In accordance with such a serial tandem image forming system, a double-side printing job can be performed at a high speed by forming an image on one side of a sheet P with one of the image forming apparatuses (for example, the upstream apparatus 200) and then forming an image on the other side of the sheet with the other image forming apparatus (for example the downstream apparatus 300).

The large volume paper feed unit 100 is a device for accumulating and storing a large volume of sheets P and supplying the upstream apparatus 200 and the downstream apparatus 300 with the sheets P. Also, with respect to the direction of conveying sheets P, the large volume paper feed unit 100 is connected to the upstream side of the upstream apparatus 200 in series. The main element of this large volume paper feed unit 100 is a paper feed unit 110. The paper feed unit 110 consists of a plurality of paper feed trays, for example, three paper feed trays 111 to 113, which may be used to store sheets P of the same size and the same type or different sizes and different types respectively. The paper feed unit 110 conveys sheets P appropriate for a current job, one by one, from a corresponding one of the paper feed trays 111 to 113 to the upstream apparatus 200.

The upstream apparatus 200 is a device for forming images on sheets P, and connected to the downstream side of the large volume paper feed unit 100. This upstream apparatus 200 is configured to receive sheets P discharged from the apparatus located in the upstream side, i.e., the large volume paper feed unit 100, and capable of forming images on sheets P discharged from the large volume paper feed unit 100 or on sheets P stored in the upstream apparatus 200 itself. The upstream apparatus 200 consists mainly of an image forming unit 230, a fixing unit 240, a conveyance unit 250 and a control unit 260.

The image forming unit 230 includes a plurality of photoreceptor drums vertically arranged in contact with one intermediate transfer belt 236 to transfer full-color images to sheets P. Specifically describing, the image forming unit 230 consists of four image forming units 230Y, 230M, 230C and 230K corresponding to yellow, magenta, cyan and black, and an intermediate transfer unit 235. While the image forming unit 230Y corresponding to yellow will be explained below, the image forming units 230M, 230C and 230K corresponding to the other colors have the same structure as the image forming unit 230Y.

The image forming unit 230Y includes a photoreceptor drum 231 and a developing unit 232. The developing unit 232 consists, for example, mainly of a charging section, an exposure section and a developing section. The charging section uniformly charges the peripheral surface of the photoreceptor drum 231. The exposure section irradiates the photoreceptor drum 231 with a laser beam to form an electrostatic latent image on the surface of the photoreceptor drum 231. The developing section makes visible the latent image formed on the surface of the photoreceptor drum 231 with toner. By this process, an image (toner image) is formed on the photoreceptor drum 231. The image formed on the photoreceptor drum 231 is successively transferred to a predetermined location of the intermediate transfer belt 236 serving as part of the intermediate transfer unit 235.

The image (full-color image) consisting of respective color images transferred to the intermediate transfer belt 236 is transferred to a sheet P with a predetermined timing by a transfer roller 237. The transfer roller 237 and the intermediate transfer belt 236 are in contact with each other and urged against each other to form a nip site (transfer nip site) therebetween.

The conveyance unit 250 consists of a paper feed tray 251 and a conveyance unit including a number of conveyance rollers and guide members. Sheets stored in the paper feed tray 251 or received from the large volume paper feed unit 100 are conveyed by the conveyance rollers and supplied to the transfer nip site with a predetermined timing in synchronization with the image on the intermediate transfer belt 235. When a sheet P is passed through the transfer nip site, an image is transferred to one side of the sheet P which is then conveyed to the fixing unit 240.

The fixing unit 240 consists of a heat roller and a pressure roller. The heat roller is provided with a built-in neat source (not shown) with which the heat roller can be controlled at a predetermined temperature. When the sheet P is passed through a fixing nip site located between the heat roller and the pressure roller during the conveyance of the sheet P, the image transferred to the sheet P is heated and pressed, and then fixed to the sheet P.

After the fixing treatment with the fixing unit 240, the sheet P is discharged out of the upstream apparatus 200 by a discharging roller. In this case, when a double-side printing job is performed in cooperation with the downstream apparatus 300 as described below, the sheet P transferred from the fixing unit 240 is conveyed to reversing rollers located below by a switching gate in order to reverse the front and back sides of the sheet P. The reversing rollers holds the tail end of the sheet P therebetween and then reverses the sheet P by sending back it to the discharging roller described above. By this process, the sheet P is discharged out of the upstream apparatus 200 by the discharging roller after reversing the front and back sides compared to the time when the sheet P was passing between the fixing nip site.

This upstream apparatus 200 is capable of not only forming an image on one side of a sheet P but also solely performing images on the opposite sides of a sheet P. When a double-side printing job is performed on a sheet P only with the upstream apparatus 200, a sheet P transferred from the fixing unit 240 after image formation on one side of the sheet P is conveyed to the reversing rollers located below by the switching gate. After holding the tail end of the sheet P which is conveyed, the reversing rollers reverses the conveyance direction of the sheet P to reverse the sides of the sheet, followed by directing the sheet P to a refeed conveying route. The sheet P directed to the refeed conveying route is then returned to the transfer nip site again by a plurality of conveyance rollers to form an image on the other side of the sheet P.

The control unit 260 serves to integrally control the image forming operation with the upstream apparatus 200. The control unit 260 controls the respective units (the image forming unit 230, the fixing unit 240 and the conveyance unit 250) of the upstream apparatus 200 in accordance with a job corresponding to the instruction input by a user to perform the operations as described below. By this configuration, a predetermined image can be formed on the sheet P.

(1) The charging section electrostatically charges the photoreceptor drum 231.

(2) The exposure section forms an electrostatic latent image on the photoreceptor drum 231.

(3) The developing section adheres toner to the electrostatic latent image.

(4) The image formed on the photoreceptor drum 231 is transferred to the sheet P through the intermediate transfer unit 235.

(5) The transferred image is fixed to the sheet P by the fixing treatment.

In the above process, the image data as base data of the image formation is acquired by the control unit 260 with a predetermined timing. For example, in the case where the image forming system is provided with an original reading unit (not shown), an original is read by this original reading unit in accordance with a job corresponding to the instruction input by a user through the manipulation display 500. By this process, the original reading unit outputs image data which is acquired by the control unit 260. Alternatively, together with a print job, the control unit 260 can acquire image data as output data from a personal computer or another image forming apparatus connected to the image forming apparatus.

Incidentally, the upstream apparatus 200 can simply convey a sheet P Through the inside thereof without forming an image to discharge the sheet P out of this apparatus, i.e., to the downstream apparatus 300 in this case.

The downstream apparatus 300 is a device for forming images on sheets P, and connected to the downstream side of the upstream apparatus 200. This downstream apparatus 300 is configured to receive sheets P discharged from the apparatus located in the upstream side, i.e., the upstream apparatus 200, and capable of forming images on sheets P discharged from the upstream apparatus 200 or on sheets P stored in the downstream apparatus 300 itself. The downstream apparatus 300 consists mainly of an image forming unit 330, a fixing unit 340, a conveyance unit 350 and a control unit 360. Meanwhile, the downstream apparatus 300 is an image forming apparatus having a similar architecture as the upstream apparatus 200, and the elements 330 to 360 constructing the downstream apparatus 300 are provided respectively corresponding to the elements 230 to 260 constructing the upstream apparatus 200. Like the upstream apparatus 200, the downstream apparatus 300 is capable of not only forming an image on one side of a sheet P but also solely performing images on the opposite sides of a sheet P, and also capable of simply conveying a sheet P inside thereof without forming an image to discharge the sheet P out of the apparatus.

The discharge unit 400 outputs sheets P discharged from the downstream apparatus 300 to the catch tray 410 on which the sheets P are stacked. In addition, this discharge unit 400 is capable of sorting sheets P in units of jobs, units of print copies, or in any arbitrary units by stacking the sheets P in different positions on the catch tray 410 or by inserting an insertion sheet indicative of separation between adjacent units.

The manipulation display 500 is provided, for example, on the top of the body of the upstream apparatus 200. The manipulation display 500 is implemented with a touch panel through which users can perform input operations with reference to information displayed on a screen such as a liquid crystal display. Through this manipulation display 500, users can instruct the control unit 260 to start a job, set printing conditions of a job (for example, the mode of single/double-side printing, the density and reduce/enlarge ratio of images, the number of print copies, and the size and paper density of sheets P), and so forth. Namely, this manipulation display 500 serves as an input device through which commands can be input by user's operation. Incidentally, operation commands to the control unit 260 can be input not only through the manipulation display 5 but also from a PC or the like connected to the image forming apparatus.

In the image forming apparatus constructed as described above, the control unit 260 of the upstream apparatus 200 is designed to communicate with the large volume paper feed unit 100, the downstream apparatus 300 and the discharge device 400, and serves also as a control device for integrally controlling the entirety of the image forming system. The control unit 260 serving as this control device sets the operation mode of the image forming system to a tandem mode, in which both the upstream apparatus 200 and the downstream apparatus 300 can operate, except for the execution period of the adjustment operation to be described below. In this tandem mode, when receiving a job, the control unit 260 forms an image on a sheet P by controlling the upstream apparatus 200 and the down stream apparatus 300. For example, when receiving a single-side printing job, the control unit 260 controls one of the upstream apparatus 200 and the downstream apparatus 300 to form an image on a sheet P by the one of the image forming apparatus. On the other hand, when receiving a double-side printing job, the control unit 260 controls both the upstream apparatus 200 and the downstream apparatus 300 to form an image on one side of a sheet P by the upstream apparatus 200, and then form an image on the other side of the sheet P by the downstream apparatus 300.

Also, the control unit 260 controls the manipulation display 500 to display information to users through the display screen of the manipulation display 500. Incidentally, the manipulation display 500 is only an implementation of an information presentation device for informing users of information. The control unit 260 can be implemented with another type of such a device, for example, a speaker which outputs vocal guidance.

Furthermore, if necessary, the control unit 260 instructs the upstream apparatus 200 and the downstream apparatus 300 to perform the adjustment operation. The instruction to perform the adjustment operation may be given to both the upstream apparatus 200 and the downstream apparatus 300 at the same time, for example, at start-up of the image forming system, or may be given to one of the apparatuses which requires the adjustment operation, for example, when a maintenance counter reaches a predetermined counter value.

This adjustment operation is performed to adjust the performance of forming images. Even if a job is given to an image forming apparatus in which the adjustment operation is being performed, this image forming apparatus cannot perform the image formation of the job until the adjustment operation finishes. The upstream apparatus 200 and the downstream apparatus 300 are image forming apparatuses having the same architecture. However, the time required to finish the adjustment operation may differ between these apparatuses because of individual differences and the differential frequency of use.

The adjustment operation includes (1) color registration error correction which is performed by forming registration marks on the intermediate transfer belt for each color component, detecting the relative displacements of the color components from the positions of the registration marks formed on the intermediate transfer belt, and correcting image writing positions on the basis of the relative displacements, (2) density adjustment which is performed by adjusting the densities of solid images for each color component, (3) gradation correction which is performed by forming a pattern having a number of gradation levels for each color component on the intermediate transfer belt, detecting densities of the gradation patterns and correcting the gradation levels with reference to the detected densities, (4) light intensity correction which is performed by emitting light from a laser diode and correcting the light intensity to an appropriate level, and so forth.

When receiving a double-side printing job while one of the upstream apparatus 200 and the downstream apparatus 300 is performing the adjustment operation, the control unit 260 displays information on the manipulation display 500 which prompts a user to select whether to immediately start the job by performing a single-machine double-side printing process or start the job by performing a serial double-side printing process after the adjustment operation finishes. In this case, the single-machine double-side printing process is a process (first double-side printing process) of forming images on both sides of a sheet P with the other image forming apparatus which is not performing the adjustment operation. On the other hand, the serial double-side printing process is a process (second double-side printing process) of forming an image on one side of a sheet P by the upstream apparatus 200 and then forming an image on the other side of the sheet P by the downstream apparatus 300.

Figure 2:
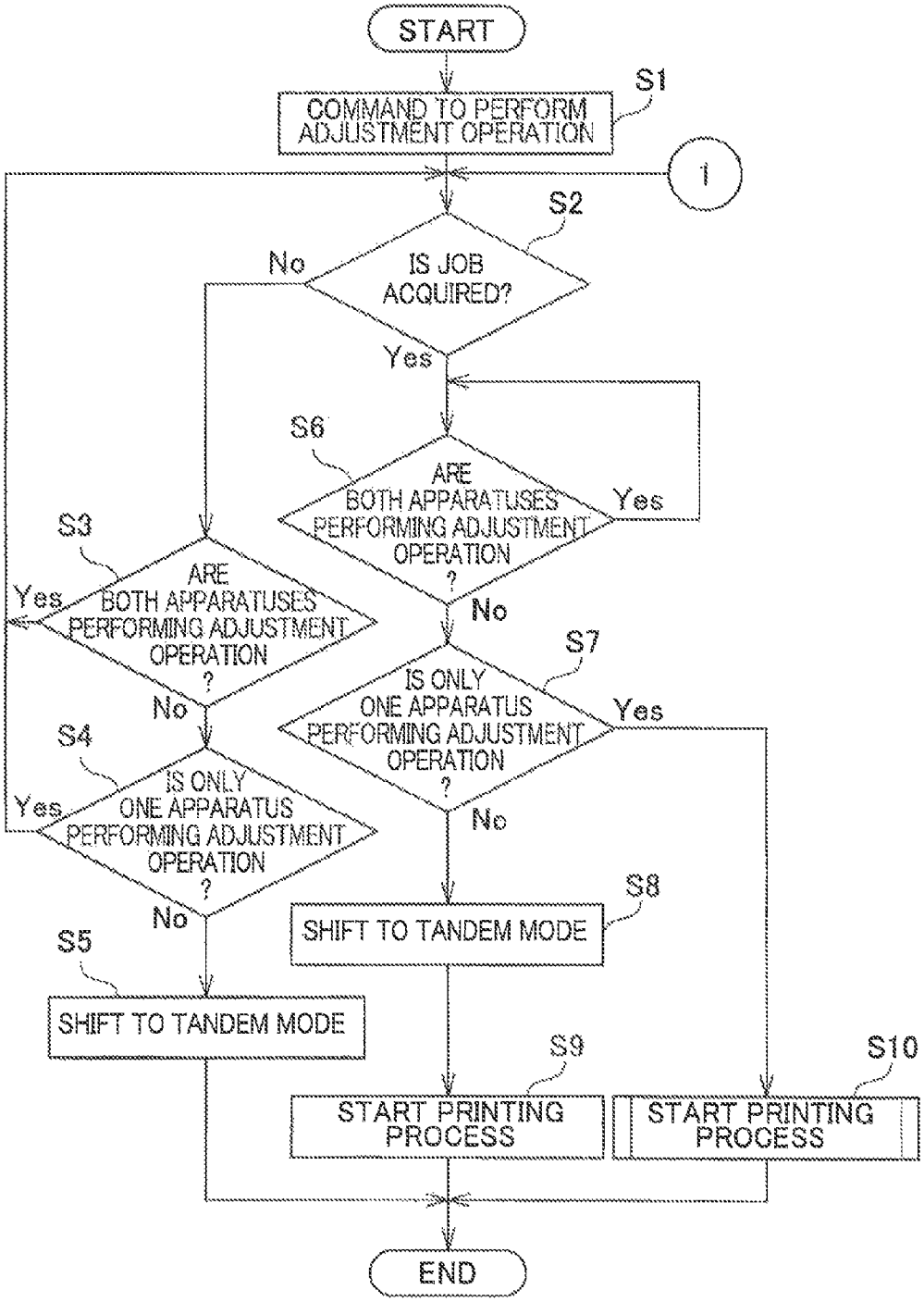
FIG. 2 is a flow chart for showing the procedure of the operation of the image forming system in accordance with the embodiment of the present invention.

FIG. 2 is a flow chart for showing the procedure of the operation of the image forming system, particularly, when the adjustment operation is performed. The procedure shown in this flow chart is called or triggered when the condition for performing the adjustment operation is satisfied, and performed by the control unit 260 which is the control device of the image forming system. The condition for performing the adjustment operation is satisfied, for example, when the image forming system starts up, when the maintenance counter of the upstream apparatus 200 or the downstream apparatus 300 reaches a predetermined counter value, when a user inputs a command for starting the adjustment operation, or when any other predetermined condition in which the adjustment operation is needed is satisfied.

At first, in step 1 (S1), the control unit 260 generates a command to perform the adjustment operation. For example, when the image forming system starts up, the control unit 260 outputs the command to perform the adjustment operation to both the upstream apparatus 200 and the downstream apparatus 300. Also, when the maintenance counter of one of the apparatuses reaches a predetermined counter value, the control unit 260 outputs the command to perform the adjustment operation to this apparatus. The apparatus receiving the command starts the adjustment operation which finishes when a predetermined correction process(es) finishes.

In step 2 (S2), the control unit 260 determines whether or not a job is received. Such a job can be acquired from the manipulation display 500 or a PC connected to the image forming apparatus. If the determination is in the negative in step 2, i.e., if the control unit 260 has not acquired a job, the process proceeds to step 3 (S3). Conversely, if the determination is in the affirmative in step 2, i.e., if the control unit 260 has acquired a job, the process proceeds to step 6 (S6).

In step 3, the control unit 260 determines whether or not both the upstream apparatus 200 and the downstream apparatus 300 are performing the adjustment operation. If the determination is in the affirmative in step 3, i.e., if both the apparatuses are performing the adjustment operation, the process returns to step 2. Conversely, if the determination is in the negative in step 3, the process proceeds to step 4 (S4).

The determination in step 3 is affirmative in the cases (a) where both the upstream apparatus 200 and the downstream apparatus 300 have received the command to perform the adjustment operation, and while one of the apparatuses continues executing the adjustment operation, the other apparatus has finished the adjustment operation, (b) where both the upstream apparatus 200 and the downstream apparatus 300 have received the command to perform the adjustment operation, and both the apparatuses have finished the adjustment operation. (c) where one of the upstream apparatus 200 and the downstream apparatus 300 has received the command to perform the adjustment operation, and continues executing the adjustment operation, (d) where one of the upstream apparatus 200 and the downstream apparatus 300 has received the command to perform the adjustment operation, and has finished the adjustment operation.

In step 4, the control unit 260 determines whether only one of the upstream apparatus 200 and the downstream apparatus 300 is performing the adjustment operation. If the determination is in the affirmative in step 4, i.e., if one of the apparatuses is performing the adjustment operation (corresponding to the above case (a) or (c)), the process returns to step 2. Conversely, if the determination is in the negative in step 4, i.e., if both the apparatuses nave finished the adjustment operation (corresponding to the above case (b) or (d)), the process proceeds to step 5 (S5).

In step 5, the control unit 260 shifts the operation mode of the image forming system to the tandem mode in which the image forming system is waiting for a job while both the upstream apparatus 200 and the downstream apparatus 300 are put on standby (ready to print according to the job). After shifting to the tandem mode, the control unit 260 maintains the image forming system in the tandem mode until the command to perform the adjustment operation is issued again.

Meanwhile, before starting the tandem mode, there may be provided an additional period in which a tandem mode adjustment operation is performed, for example, by correcting mismatches relating to the position, densities, color balance of images or the like between the upstream apparatus 200 and the downstream apparatus 300.

In step 6, the control unit 260 determines whether or not both the upstream apparatus 200 and the downstream apparatus 300 are performing the adjustment operation in the same manner as in step 3. If the determination is in the affirmative in step 6, the process in step 6 is repeated as a loop process. By this loop process, the job is waiting until the adjustment operation finishes in either of the upstream apparatus 200 and the downstream apparatus 300, and performed after the completion. Conversely, if the determination is in the negative in step 6, the process proceeds to step 7 (S7).

In step 7, the control unit 260 determines whether only one of the upstream apparatus 200 and the downstream apparatus 300 is performing the adjustment operation in the same manner as in step 4. If the determination is in the negative in step 7, the process proceeds to step 8 (S8). Conversely, if the determination is in the affirmative in step 7, the process proceeds to step 10 (S10) to be described below.

In step 8, the control unit 260 shifts the operation mode of the image forming system to the tandem mode in the same manner as in step 5. Then, in step 9 (S9), the control unit 260 starts the printing process corresponding to the job with both the upstream apparatus 200 and the downstream apparatus 300. More specifically speaking, when a single-side printing job is performed, the control unit 260 selects one of the upstream apparatus 200 and the downstream apparatus 300 to form an image on one side of a sheet P. Also, when a double-side printing job is performed, the control unit 260 forms images both the opposite sides of a sheet P by forming an image on one side of the sheet P by the upstream apparatus 200, and then forming an image on the other side of the sheet P by the downstream apparatus 300.

Figure 3:
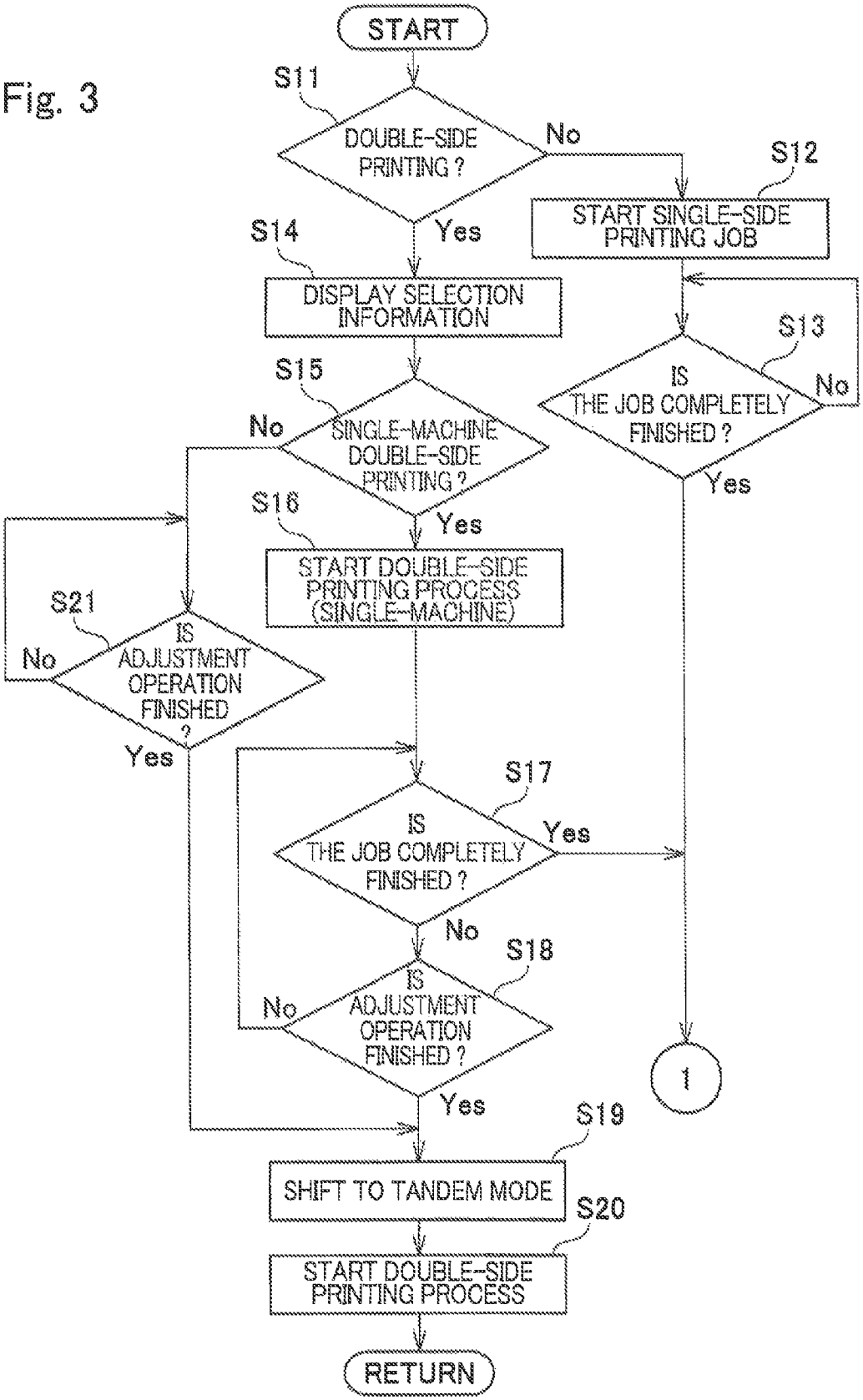
FIG. 3 is a flow chart showing the details of the printing process in step 10 of the flow chart shown in FIG. 2.

On the other hand, in step 10 (S10), the control unit 260 performs a printing process selected by a user or according to the job in an environment where the image forming system is not in the tandem mode. FIG. 3 is a flow chart showing the details of the printing process in step 10.

In step 11 (S11), the control unit 260 determines whether or not the job is a double-side printing job. In step 11, if the determination is in the negative, i.e., if the job is a single-side printing job, the process proceeds to step S12 (312). Conversely, if the determination is in the affirmative in step 11, i.e., if the job is a double-side printing job, the process proceeds to step 14 (S14).

In step 12, the control unit 260 performs the job with the image forming apparatus which is one of the upstream apparatus 200 and the downstream apparatus 300 and not performing the adjustment operation. Namely, this image forming apparatus starts the single-side printing job to form an image on one side of a sheet P.

In step 13 (S13), the control unit 260 determines whether or not the printing process of the job has completely finished. If the determination is in the affirmative in step 13, i.e., if the printing process of the job has completely finished, the process returns to step 2 which is performed as described above. If the determination is in the negative in step 13, i.e., if the printing process of the job has not completely finished, the process repeats step 13.

On the other hand, in step 14, the control unit 260 controls the manipulation display 500 to display selection information in the display screen of the manipulation display 500. This selection information is to prompt a user to select whether to immediately start the job by performing a single-machine double-side printing process or start the job by performing a serial double-side printing process after waiting until the adjustment operation finishes in one of the image forming apparatuses and shifting to the tandem mode.

For example, the control unit 260 may display any appropriate names indicative of the above printing processes as options which can be selected on the display screen of the manipulation display 500, for example, "Single-machine double-side printing" corresponding to the former option. Also, in place of or in addition to the names, the control unit 260 may display reference information, for example, "When performing single-machine double-side printing, the operation mode may shift to the tandem mode during printing" on the display screen of the manipulation display 500. Likewise, corresponding to the latter option, the control unit 260 may display any appropriate name of the printing process on the display screen of the manipulation display 500, for example, "Serial double-side printing" or "Tandem mode" on the display screen of the manipulation display 500.

Also, in place of or in addition to this name, the control unit 260 may display reference information, for example, "When performing serial double-side printing, the image quality is preserved" on the display screen of the manipulation display 500. Incidentally, from the view point of productivity and image quality, reference information may be selected from among a variety of messages indicative of the feature of the printing process. For example, while the single-machine double-side printing process is selected particularly when giving priority to productivity as described below, the reference information may include this information. On the other hand, while the serial double-side printing process is selected when giving priority to image quality, the reference information may include this information.

In step 15 (S15), the control unit 260 determines whether or not a user has selected the single-machine double-side printing process on the basis of input from the manipulation display 500. If the determination is in the affirmative in step 15, i.e., if the single-machine double-side printing process is selected, the process proceeds to step 16 (S16). Conversely, if the determination is in the negative in step 15, i.e., if the serial double-side printing process is selected, the process proceeds to step 21 (S21).

In step 16, the control unit 260 performs the job with the image forming apparatus which is one of the upstream apparatus 200 and the downstream apparatus 300 and not performing the adjustment operation. The single-machine double-side printing process thereby starts.

For example, when only the downstream, apparatus 300 is performing the adjustment operation, images are formed on both the opposite sides of a sheet P by the use of the upstream apparatus 200. Namely, the upstream apparatus 200 forms an image on one side of a sheet P supplied from the large volume paper feed unit 100 or the paper feed tray 251 installed in the upstream apparatus 200 itself, and then forms an image also on the other side of the sheet P. The sheet P with the printed opposite sides is discharged to the downstream apparatus 300 which is performing the adjustment operation. The downstream apparatus 300 discharges the sheet P received from the upstream apparatus 200 to the discharge device 400 while the paper conveyance does not interfere with the adjustment operation which is being performed.

On the other hand, when only the upstream apparatus 200 is performing the adjustment operation, images are formed on both the opposite sides of a sheet P by the use of the downstream apparatus 300. That is, the downstream apparatus 300 forms an image on one side of a sheet P supplied from the large volume paper feed unit 100 through the upstream apparatus 200 performing the adjustment operation, and then forms an image also on the other side of the sheet P. Then, the sheet P with the printed opposite sides is discharged to the discharge device 400. In this case, the upstream apparatus 200 performing the adjustment operation discharges the sheet P to the downstream apparatus 300 while the paper conveyance does not interfere with the adjustment operation which is being performed.

Furthermore, if the image forming apparatus performing the adjustment operation is the upstream apparatus 200, it is possible to perform the double-side printing process by the downstream apparatus 300, if available, even while the paper conveyance through the upstream apparatus 200 does interfere with the adjustment operation which is being performed. This becomes possible by performing the single-machine double-side printing process with sheets supplied from the paper feed tray 351 of the downstream apparatus 300 itself rather than supplied from the large volume paper feed unit 100.

In step 17 (S17), the control unit 260 determines whether or not the printing process of the job has completely finished. If the determination is in the affirmative in step 17, i.e., if the printing process of the job has completely finished, the process returns to step 2 which is performed as described above. Conversely, if the determination is in the negative in step 17, i.e., if the printing process of the job has not completely finished, the process proceeds to step 18 (S18).

In step 18, the control unit 260 determines whether or not the adjustment operation has finished in the one image forming apparatus that was determined in step 7 as performing the adjustment operation. If the determination is in the affirmative in step 18, i.e., if the adjustment operation has completely finished, the process proceeds to step 19 (S19). Conversely, if the determination is in the negative in step 18, i.e., if the adjustment operation has not completely finished, the process returns to step 17.

In step 19, the control unit 260 halts the single-machine double-side printing process and then shifts the operation mode of the image forming system to the tandem mode. Then, in step 20 (S20), the control unit 260 performs the print process corresponding to the backlog of the job with both the upstream apparatus 200 and the downstream apparatus 300, The serial double-side printing process then starts to perform the backlog of the job.

Figure 4A:
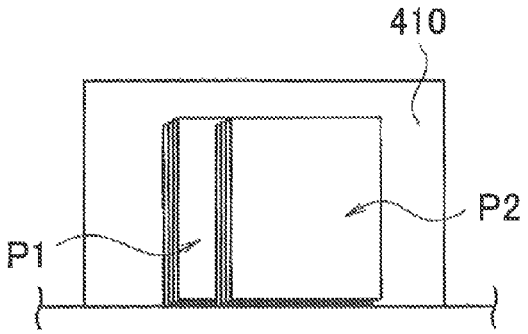
FIGS. 4A and 4B are explanatory views for schematically showing the stacking states of sheets which are discharged in accordance with the embodiment of the present invention.
Figure 4B:
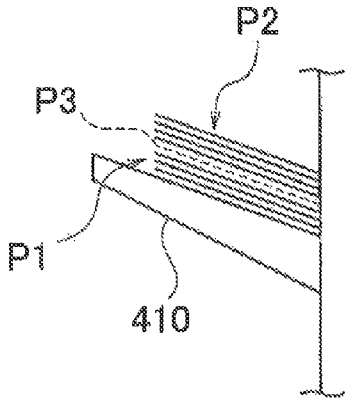

In this case, the control unit 260 may control the discharge device 400 in order to make clear the boundary between a stack of sheets P printed by the single-machine double-side printing process and a stack of sheets P printed by the serial double-side printing process after shifting to the tandem mode. More specifically, the discharge device 400 may sort printed sheets P by stacking the sheets P (P1) printed by the single-machine double-side printing process and the sheets P (P2) printed after shifting to the tandem mode, i.e., printed by the serial double-side printing process in different positions on the catch tray 410 as illustrated in FIG. 4A. Alternatively, as Illustrated in FIG. 4B, the discharge device 400 may sort printed sheets P by inserting an insertion sheet P3 indicative of the boundary between a stack of sheets P (P1) printed by the single-machine double-side printing process and a stack of sheets P (P2) printed by the serial double-side printing process. The insertion sheet P3 may be of a different type of paper than the sheets P1 and P2 (for example, in color, paper material, paper density and/or size), or discharged in a position offset from the sheets P1 and P2, such that the insertion sheet P3 becomes distinctive.

On the other hand, in step 21 (S21) following the negative determination in step 15, the control unit 260 determines whether or not the adjustment operation has finished in the one image forming apparatus that was determined in step 7 as performing the adjustment operation. If the determination is in the affirmative in step 21, i.e., if the adjustment operation has completely finished, the process proceeds to step 19 (S19). Conversely, if the determination is in the negative in step 21, i.e., if the adjustment operation has not completely finished, the process repeats step 21.

The process waits in step 21 until the adjustment operation finishes in the one image forming apparatus, and then shifts to the tandem mode. The control unit 260 then performs ail the print process corresponding to the job with both the upstream apparatus 200 and the downstream apparatus 300. Namely, the print process of the job starts as the serial double-side printing process.

As has been discussed above, the image forming system of the present embodiment is a serial tandem image forming system with the upstream apparatus 200 and the downstream apparatus 300 each of which is capable of forming images on both sides of a sheet P. Also, when receiving a double-side printing job while one of the upstream apparatus 200 and the downstream apparatus 300 is performing the adjustment operation, the control unit 260 which is the control device of the image forming system displays information on the manipulation display 500 which prompts a user to select whether to immediately start the job by performing a single-machine double-side printing process with the other image forming apparatus which is not performing the adjustment operation, or start the job by shifting to the tandem mode and performing a serial double-side printing process after the one image forming apparatus finishes the adjustment operation.

Figure 5:
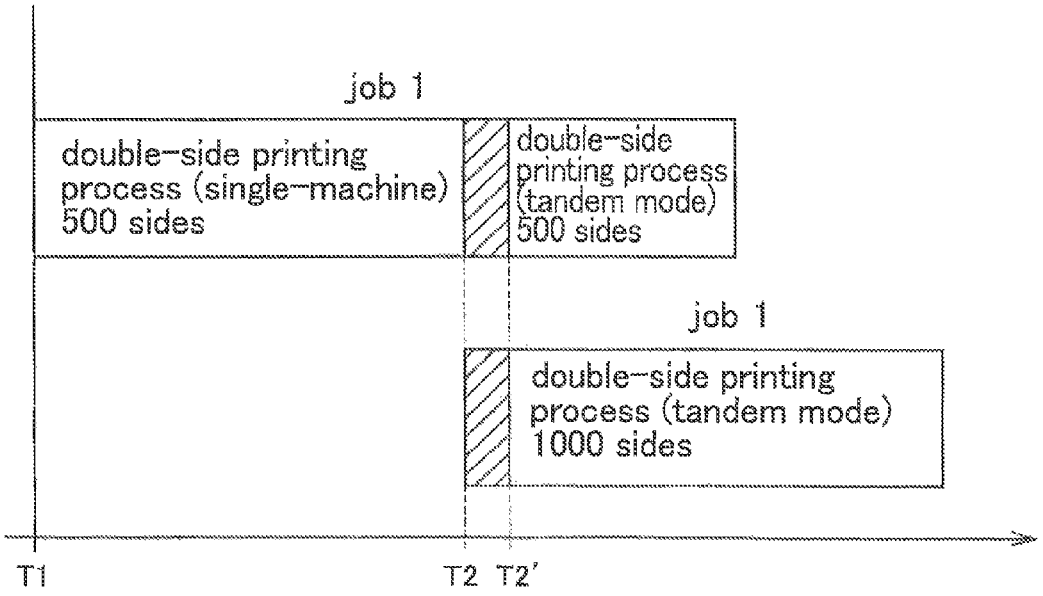
FIG. 5 is an explanatory view for showing schemes of performing a job.

FIG. 5 is an explanatory view for showing schemes of performing a job. In the same figure, on the assumption that both the upstream, apparatus 200 and the downstream apparatus 300 receive a command for starting the adjustment operation, one of the image forming apparatuses finishes the adjustment operation with a time T1, and the other image forming apparatus finishes the adjustment operation with a time T2. Incidentally, a time T2' is the time at which the tandem mode adjustment operation finishes.

Even if one of the image forming apparatuses is performing the adjustment operation when the image forming system of the present embodiment receives a double-side printing job, the other image forming apparatus starts a single-machine double-side printing process without waiting until both the upstream apparatus 200 and the downstream apparatus 300 become fully functional and can perform print processes (as shown in FIG. 5 with the lower square where the job starts only at the time 12). As a result, it is possible to improve the productivity.

On the other hand, when the adjustment operation is finished, the one image forming apparatus autonomously returns to a state (functional state) in which image formation can be performed, the operation mode of the image forming system is shifted to the tandem mode to continue the print process as a serial double-side printing process. After shifting to the tandem mode, the productivity is further improved than when the single-machine double-side printing process continues. As has been discussed above, a double-side printing job can start as quick as possible while avoiding the influence of the adjustment operation of the image forming apparatus, i.e., the upstream apparatus 200 or the downstream apparatus 300, so that the downtime of the system can be reduced. On the other hand, it is also possible to wait until both the upstream apparatus 200 and the downstream apparatus 300 become fully functional, and then shift to the tandem mode in which a job starts by a serial double-side printing process. In this case, there is the advantage that the printing process is continuously performed through a single job without switching between a serial double-side printing process and a single-machine double-side printing process to give uniformity to the appearance of the printed paper.

In this regard, according to the present embodiment, users can select whether to wait until the one image forming apparatus finish the adjustment operation and then start a job or immediately start the job. The operation of the image forming system can thereby be determined in accordance with the needs of users, i.e., preference to the speed of finishing a job or preference to the qualities of images, so that convenience of users is improved.

Also, according to the present embodiment, if the adjustment operation of one of the image forming apparatuses finishes in advance of finishing a job which is performed by a single-machine double-side printing process with the other image forming apparatus in accordance with the selection by a user, the control unit 260 shifts the operation mode of the image forming system to the tandem mode in which the backlog of the print job is performed by switching the single-machine double-side printing process to a serial double-side printing process.

This scheme makes it possible to quickly finish the backlog of the print job by switching the serial double-side printing process from the single-machine double-side printing process when finishing the adjustment operation of the one image forming apparatus. Hence, as illustrated in FIG. 5 with the upper square, the time required to finish a job can be shorter than when the entirety of the print process for the job is performed by a single-machine double-side printing process. It is therefore possible to improve the productivity of the image forming system.

Furthermore, according to the present embodiment, the control unit 260 may display reference information about the characteristics such as advantages and disadvantages of the single-machine double-side printing process and the serial double-side printing process on the manipulation display 500.

While users familiar with image forming system may be able to select one option only with reference to the names given to the optional processes respectively, inexperienced users may not understand the outlines of the processes from the names, and cannot select an appropriate option. In this regard, the user-friendliness can be improved by providing users with the reference information in addition to or in place of the names to help the users to conceptually understand which process should be selected.

Also, according to the present embodiment, the control unit 260 may control the discharge device 400 in order to make clear the boundary between a stack of sheets P printed by a single-machine double-side printing process and a stack of sheets P printed by a serial double-side printing process.

By this configuration, it is possible to provide a user the boundary of sheets P corresponding to the switching of the process. The print image quality can thereby be easily controlled so that the user-friendliness can be improved.

Furthermore, according to the present embodiment, when a double-side printing job is received while both the upstream apparatus 200 and the downstream apparatus 300 are performing the adjustment operation, the control unit 260 starts the printing job after waiting until one of the image forming apparatuses finishes the adjustment operation.

While the upstream apparatus 200 and the downstream apparatus 300 are image forming apparatuses having the same architecture, the time required to finish the adjustment operation may differ between these apparatuses because of individual differences and the differential frequency of use. Because of this, even if the command to perform the adjustment operation is output to both the upstream apparatus 200 and the downstream apparatus 300, one of the image forming apparatuses may finish the adjustment operation ahead of the other. In this regard, according to the present embodiment, the one image forming apparatus having finished the adjustment operation starts the job ahead of the other without waiting until both the upstream apparatus 200 and the downstream apparatus 300 become fully functional. This scheme can be selected by users as described above, and thereby user convenience can be improved.

The foregoing description has been presented on the basis of the image forming system according to the present embodiment. However, it is not intended to limit the present invention, to the precise form described, and obviously many modifications and variations are possible within the scope of the invention. For example, an image forming apparatus based on another printing technique than the electrophotography can be used as the upstream apparatus and/or the downstream apparatus of a tandem image forming system according to the present invention.

Also, the upstream apparatus and the downstream apparatus can be connected in series with an intervening relay apparatus which can reverse the front and back sides of a sheet received from the upstream apparatus and transfer the sheet to the downstream apparatus. In this case, when a job is performed by a serial double-side printing process, the relay apparatus performs the reversing of sheets printed by the upstream apparatus. In the case where such a relay device is installed in the image forming system, the upstream apparatus and the downstream apparatus need not be provided with the functionality of reversing a sheet. Furthermore, the structures of the upstream apparatus and the downstream apparatus need not be identical in a strict sense, but it is only necessary to perform a single-machine double-side printing process respectively.

On the other hand, in the case of the embodiment as described above, the control unit of the upstream apparatus serves as the control device of the overall image forming system. However, the functionality of the control device may be implemented within any other control unit such as the control unit of the downstream apparatus. Alternatively, a dedicated control device may be separately installed for this functionality.

In addition, according to the embodiment as discussed above, when a sheet is transferred through an image forming apparatus performing the adjustment operation, the same conveying route is used for this purpose as for forming images in this image forming apparatus. However, the present invention is not limited, thereto. For example, for each of the upstream apparatus and the downstream apparatus, a bypass route is provided separate from the conveying route for forming images to transfer a sheet by bypassing the conveying route. In this case, a sheet can be transferred through an image forming apparatus even when this image forming apparatus is performing the adjustment operation.

The invention claimed is:

1. An image forming system comprising:

a first image forming apparatus configured to form images on one side and both sides of a sheet;

a second image forming apparatus connected to said first image forming apparatus in series and configured to receive a sheet, which is discharged from said first image forming apparatus, and form images on one side and both sides of the sheet;

an information presentation device configured to inform a user of information;

an input device configured to receive a command input by the user; and a control device configured to control said first image forming apparatus and said second image forming apparatus, wherein, when starting a job of printing both sides of sheets while one of said first image forming apparatus and said second image forming apparatus is performing an adjustment operation for adjusting the performance of image formation, said control device provides information through said information presentation device which prompts the user to select whether to start the job by forming images on both sides of each sheet as a first double-side printing process with the other image forming apparatus which is not performing the adjustment operation, or start the job, after said one image forming apparatus has finished the adjustment operation, by forming an image on one side of each sheet with said first image forming apparatus and then forming an image on the other side of said each sheet with said second image forming apparatus as a second double-side printing process, wherein said control device starts the job by forming images on both sides of each sheet as the first double-side printing process with the other image forming apparatus which is not performing the adjustment operation, if the user selects forming images on both sides of each sheet with the other image forming apparatus which is not performing the adjustment operation; and starts the job by forming an image on one side of each sheet with said first image forming apparatus and then forming an image on the other side of said each sheet with said second image forming apparatus as the second double-side printing process after said one image forming apparatus has finished the adjustment operation, if the user selects forming an image on one side of each sheet with said first image forming apparatus and then forming an image on the other side of said each sheet with said second image forming apparatus after said one image forming apparatus has finished the adjustment operation.

2. The image forming system of claim 1 wherein if the adjustment operation of the one of said first and second image forming apparatuses has finished before completely finishing the printing process of a job which is started in accordance with the selection by the user as said first double-side printing process, said control device switches said first double-side printing process to said second double-side printing process to perform the backlog of the job.

3. The image forming system of claim 1 wherein said control device provides reference information about the characteristics of said first double-side printing process and said second double-side printing process through said information presentation device.

4. The image forming system of claim 1 further comprising a discharge device connected to said second image forming apparatus in series and configured to receive a sheet output from said second image forming apparatus and discharge the sheet to a catch tray, wherein said control device controls said discharge device in order to make clear the boundary between a stack of sheets printed by said first double-side printing process and a stack of sheets printed by said second double-side printing process.

5. The image forming system of claim 1 wherein when both said first image forming apparatus and said second image forming apparatus are performing the adjustment operation, said control device waits until one of said first image forming apparatus and said second image forming apparatus finishes the adjustment operation, and then performs the job of printing both sides of sheets.

6. A method of controlling an image forming system comprising:

a first image forming apparatus configured to form images on one side and both sides of a sheet;

a second image forming apparatus connected to said first image forming apparatus in series and configured to receive a sheet, which is discharged from said first image forming apparatus, and form images on one side or both sides of the sheet, said method comprising:

a step of acquiring a job of printing both sides of sheets while one of said first image forming apparatus and said second image forming apparatus is performing an adjustment operation for adjusting the performance of image formation;

a step of providing information which prompts the user to select whether to start the job by forming images on both sides of each sheet as a first double-side printing process with the other image forming apparatus which is not performing the adjustment operation, or start the job, after said one image forming apparatus has finished the adjustment operation, by forming an image on one side of each sheet with said first image forming apparatus and then forming an image on the other side of said each sheet with said second image forming apparatus as a second double-side printing process;

a step of starting the job by forming images on both sides of each sheet as the first double-side printing process with the other image forming apparatus which is not performing the adjustment operation, if the user selects forming images on both sides of each sheet with the other image forming apparatus which is not performing the adjustment operation; and a step of starting the job by forming an image on one side of each sheet with said first image forming apparatus and then forming an image on the other side of said each sheet with said second image forming apparatus as the second double-side printing process after said one image forming apparatus has finished the adjustment operation, If the user selects forming an image on one side of each sheet with said first image forming apparatus and then forming an image on the other side of said each sheet with said second image forming apparatus after said one image forming apparatus has finished the adjustment operation.

7. A method of controlling an image forming system comprising:

a first image forming apparatus configured to form images on one side and both sides of a sheet;

a second image forming apparatus connected to said first image forming apparatus in series and configured to receive a sheet, which is discharged from said first image forming apparatus, and form images on one side or both sides of the sheet, said method comprising:

a step of acquiring a job of printing both sides of sheets while one of said first image forming apparatus and said second image forming apparatus is performing an adjustment operation for adjusting the performance of image formation; and a step of providing information which prompts a user to select which of productivity and image quality is given priority than the other;

a step of starting, when the user selects productivity, the job by forming images on both sides of each sheet as a first double-side printing process with the other image forming apparatus which is not performing the adjustment operation; and a step of starting, when the user selects image quality and after said one image forming apparatus has finished the adjustment operation, the job by forming an image on one side of each sheet with said first image forming apparatus and then forming an image on the other side of said each sheet with said second image forming apparatus as a second double-side printing process.

8. An image forming system comprising:

a first image forming apparatus configured to form images on one side and both sides of a sheet;

a second image forming apparatus connected to said first image forming apparatus in series and configured to receive a sheet, which is discharged from said first image forming apparatus, and form images on one side and both sides of the sheet;

an information presentation device configured to inform a user of information;

an input device configured to receive a command input by the user; and a control device configured to control said first image forming apparatus and said second image forming apparatus, wherein, when starting a job of printing both sides of sheets while one of said first image forming apparatus and said second image forming apparatus is performing an adjustment operation for adjusting the performance of image formation, said control device provides information through said information presentation device which prompts the user to select whether to start the job by forming images on both sides of each sheet as a first double-side printing process with the other image forming apparatus which is not performing the adjustment operation, or start the job, after said one image forming apparatus has finished the adjustment operation, by forming an image on one side of each sheet with said first image forming apparatus and then forming an image on the other side of said each sheet with said second image forming apparatus as a second double-side printing process, and wherein said control device provides reference information about the characteristics of said first double-side printing process and said second double-side printing process through said information presentation device, the characteristics including productivity and image quality.

9. A method of controlling an image forming system comprising:

a first image forming apparatus configured to form images on one side and both sides of a sheet;

a second image forming apparatus connected to said first image forming apparatus in series and configured to receive a sheet, which is discharged from said first image forming apparatus, and form images on one side or both sides of the sheet, said method comprising:

a step of acquiring a job of printing both sides of sheets while one of said first image forming apparatus and said second image forming apparatus is performing an adjustment operation for adjusting the performance of image formation; and a step of providing information which prompts the user to select whether to start the job by forming images on both sides of each sheet as a first double-side printing process with the other image forming apparatus which is not performing the adjustment operation, or start the job, after said one image forming apparatus has finished the adjustment operation, by forming an image on one side of each sheet with said first image forming apparatus and then forming an image on the other side of said each sheet with said second image forming apparatus as a second double-side printing process, wherein the information provided includes reference information about the characteristics of said first double-side printing process and said second double-side printing process, the characteristics including productivity and image quality.

* * * * *